United States Patent [19]

Lane et al.

[11] Patent Number: 4,946,406

[45] Date of Patent: Aug. 7, 1990

[54] ELECTRICAL CONNECTOR WHICH REQUIRES NO APPLICATION TOOL

[75] Inventors: David Lane, Greensboro; Richard A. Nelson, Winston-Salem, both of N.C.

[73] Assignee: AMP Incorporated, Harrisburg, Pa.

[21] Appl. No.: 354,177

[22] Filed: May 19, 1989

[51] Int. Cl.[5] ..... H01R 4/24

[52] U.S. Cl. ..... 439/417; 439/421; 439/699

[58] Field of Search ..... 439/389–401, 439/404–407, 421–427, 438–442, 417–419, 699

[56] References Cited

U.S. PATENT DOCUMENTS

| | | | |
|---|---|---|---|
| 2,673,968 | 3/1954 | Smith | 439/417 |
| 4,114,975 | 9/1978 | Weidler | 339/176 M |
| 4,221,445 | 9/1980 | Fleischhacker et al. | 339/18 R |
| 4,312,556 | 1/1982 | Dufau | 439/399 |
| 4,335,929 | 6/1982 | Abernethy | 339/97 R |
| 4,522,460 | 6/1985 | Beck, Jr. et al. | 439/421 |
| 4,662,701 | 5/1987 | Lane | 339/176 M |
| 4,773,867 | 9/1988 | Keller et al. | 439/49 |

OTHER PUBLICATIONS

"Berg Male Clincher Connector", Berg Electronics, Dec. 1982, cl. 439 sc 418.

*Primary Examiner*—David L. Pirlot
*Attorney, Agent, or Firm*—Eric Groen

[57] ABSTRACT

Preloaded electrical connector comprises a housing having a terminal therein which is partially inserted into a terminal-receiving cavity. The terminal has a wire contacting lancet thereon and the housing cavity has camming wall portions which are effective, during movement of the terminal to its fully inserted position, to move the contacting lancet into engagement with a wire. Installation is carried out by inserting a wire into the partially inserted terminal and then moving the terminal from its partially inserted position to its fully inserted position. No specialized tooling is required for the installation process.

20 Claims, 5 Drawing Sheets

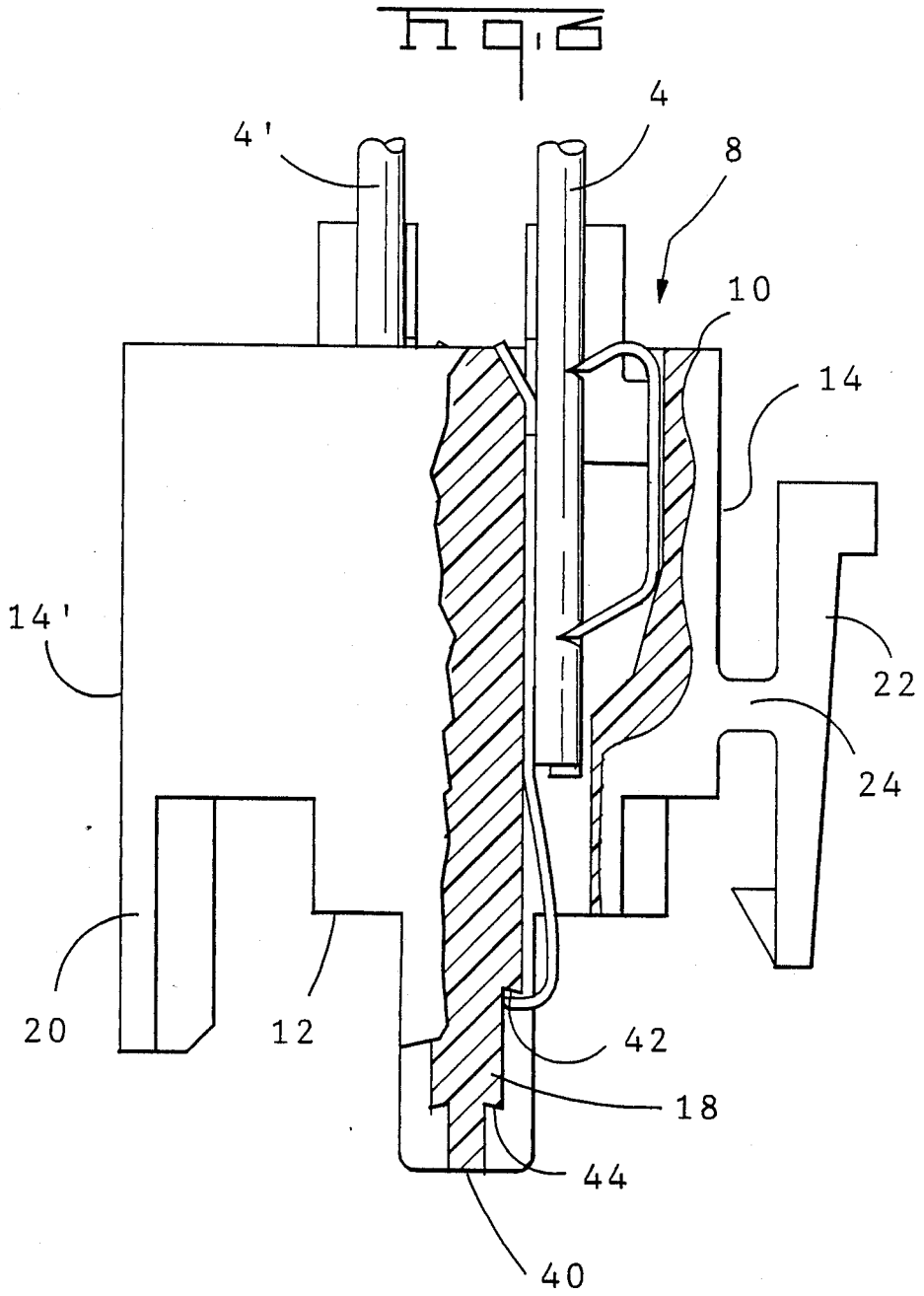
4'
4
8
10
14
14'
22
24
20
12
42
18
44
40

ELECTRICAL CONNECTOR WHICH REQUIRES NO APPLICATION TOOL

FIELD OF THE INVENTION

This invention relates to preloaded electrical connectors of the type comprising an insulating housing containing contact terminals. The invention particularly is concerned with connectors which can be installed on the ends of wires without the use of a specialized application tool.

BACKGROUND OF THE INVENTION

It is common practice to produce electrical connectors as preloaded connectors which comprise an insulating housing having the contact terminals inserted into cavities in the housing. When the connector is placed in service, wires are attached and connected to the individual terminals, usually by the use of an insertion machine or tool which inserts the individual wires into wire-receiving slots in the individual terminals and taught, for example, by U.S. Pat. No. 3,760,335. A variety of insertion or application tools are available for inserting wires into the wire-receiving slots of connectors of the type described in that patent. Automatic and semi-automatic tooling is used when the connectors are being installed on wires in a factory and hand tools are used for field installation. The hand tools are highly specialized and their use is justified only if a field technician is required to install a relatively large number of connectors on wire ends.

Under some circumstances, it would be desirable to avoid the need for a specialized tool for installing preloaded connectors on wire ends. For example, U.S. Pat. No. 4,662,701 (which is hereby incorporated by reference) discloses a distribution system for telephone lines or other data transmission lines in which a connector of the type described in U.S. Pat. No. 3,760,335 is installed at a central distribution site. Individual two-conductor plug connectors are used at the distribution site to connect a pair of two conductors at the distribution site to a particular station served by the distribution site. Thus, when a technician wishes to install a telephone or other type of equipment at a particular station, he will use a two-position plug connector on at least one end of a twisted pair of wires and insert the plug connector into the multi-contact distribution connector. He may use a two-position plug connector on the other ends of the wires as shown in FIG. 2 of U.S. Pat. No. 4,662,701. The distribution system described in that patent is extremely flexible and changes in the distribution pattern can be made very easily by simply interchanging the positions of the two-position plug connectors. The technician making wiring changes must then have available jumpers of varying lengths having two position plug connectors on their ends for making connections to the central distribution site and to the work station or other remote station. The lengths of these jumpers will depend upon the precise locations of the distribution site and the work station.

It would be desirable if the technician could be provided with a two position plug connector which would be preloaded and which could be installed on the ends of a twisted pair of wires without a specialized tool. The technician could then make his own jumper cables as required in the course of making wiring changes. The present invention, in accordance with one aspect thereof, is directed to the achievement of a two position plug connector of the general tYpe described in U.S. Pat. No. 4,662,701, which can be installed on the ends of two wires without the use of a specialized tool.

In accordance with a further aspect thereof, the invention is directed to the achievement of a preloaded electrical connector which does not require installation tooling and which might be used under a wide variety of circumstances other than as a two wire plug connector as described above.

THE INVENTION

In accordance with one aspect thereof, an electrical connector in accordance with the invention comprises an insulating housing and at least one stamped and formed contact terminal in the housing. The housing has a conductor-receiving face and has at least one terminal-receiving cavity extending into the housing from the conductor-receiving face. The terminal has a conductor-receiving portion at one end thereof and has a conductor contacting portion which is adjacent to the conductor-receiving portion. The terminal is partially inserted into the cavity and is movable from its partially inserted position to a fully inserted position. The connector is characterized in that the conductor contacting portion of the terminal has contacting means which is movable against, and into contacting engagement with, a conductor. The terminal has a conductor guide means for guiding a conductor to the contacting means upon insertion of a conductor into the terminal from the one end of the terminal. The cavity has camming surface portions for moving the contacting means into engagement with a conductor during movement of the terminal from its partially inserted position into its fully inserted position whereby upon insertion of a conductor into the terminal and subsequent movement of the terminal into the cavity to its fully inserted position, the contacting means will contact the conductor and the conductor will be electrically connected to the terminal.

The embodiment of the invention described in detail below has a mating face which is oppositely directed with respect to the conductor-receiving face and the cavity extends entirely through the housing to the mating face. The terminal has an external contact portion extending from the conductor contacting portion, the external contact portion being proximate to the mating face and being adapted to contact a terminal in a complementary connecting device. In the preferred embodiment described below, the housing has a nose portion projecting from the mating face and the external contact portion extends onto the nose portion.

The preferred embodiment of the invention described below is a two position plug connector intended for use in a distribution system as described above. The terminals are in side-by-side mirror-image relationship to each other in the housing and the housing is dimensioned such that it can be positioned immediately adjacent to an identical housing in a receptacle connector.

THE DRAWING FIGURES

FIG. 3 is a plan view of a short section of strip having terminals in accordance with the invention attached thereto.

FIG. 6 is a view similar to FIG. 2 but showing the positions of the terminals after installation of the connector on the ends of wires.

THE DISCLOSED EMBODIMENT

Figure 1:
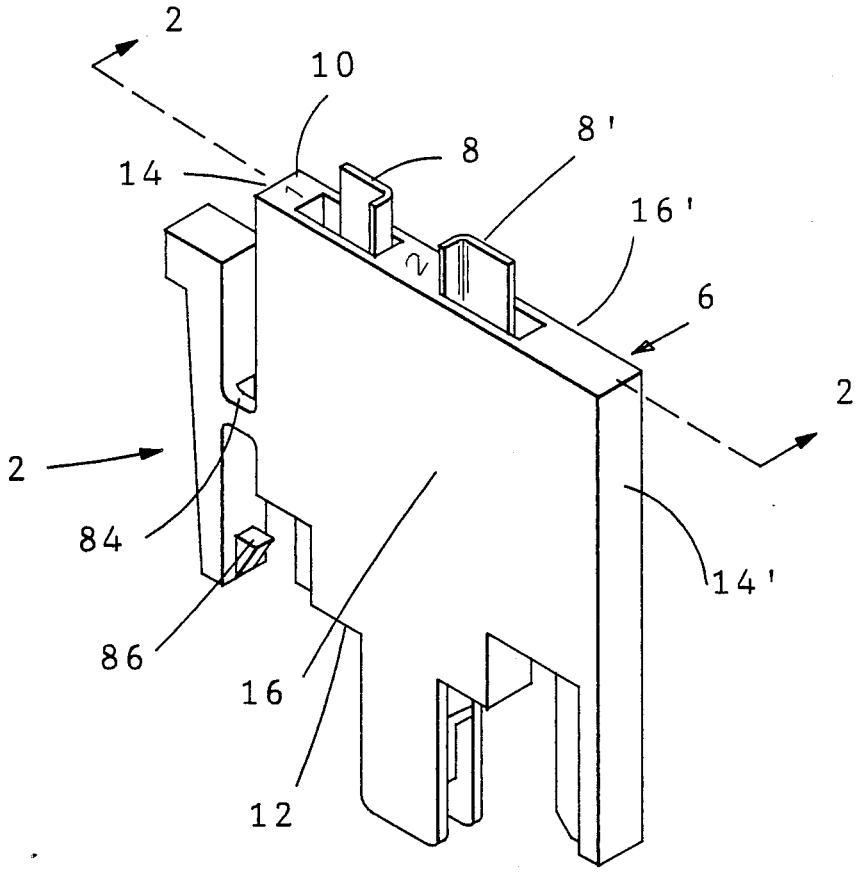
FIG. 1 is a perspective view of a connector plug in accordance with the invention showing the terminals in their partially inserted positions.

A two-position plug connector 2 in accordance with the invention (FIG. 1) is intended for installation on the ends of wires 4, 4' as shown in FIG. 6. A twisted pair of wires having a connector 2 on each end of the pair serves as a jumper for use in a distribution system as shown in U.S. Pat. No. 4,662,701. The connector assembly comprises a housing 6 and terminals 8, 8'.

The housing is of molded insulating material and has a wire-receiving face or rear face 10, a mating face 12 which is directed oppositely with respect to the rear face, oppositely facing end walls 14, 14' and oppositely facing side walls 16, 16'. The end walls 14, 14' are relatively narrow and the side walls are flat so that a plurality of plug connectors can be stacked against each other in a connector assembly as described in U.S. Pat. No. 4,662,701.

A centrally located nose 18 projects from the mating face 12 and an arm 20 projects from the mating face adjacent to the end wall 14'. A latch arm 22 is pivoted by a flexible neck 24 to the end wall 14 and serves to latch the plug connector to a complementary receptacle when the plug is inserted into the receptacle.

Figure 4:
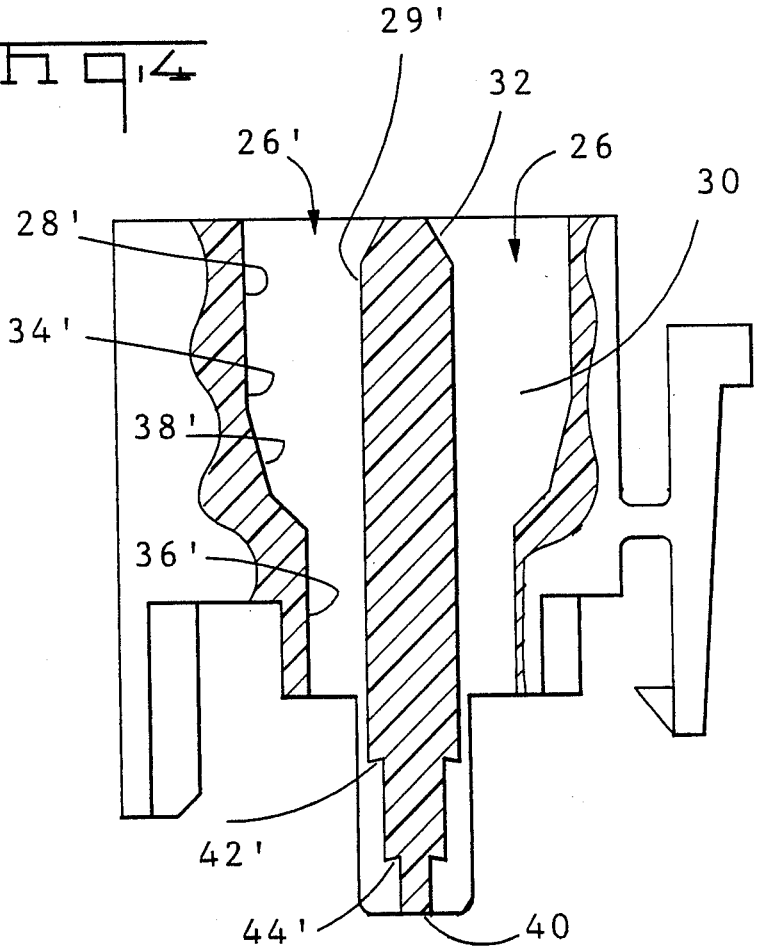
FIG. 4 is a view similar to FIG. 2 but without terminals in the terminal-receiving cavities of the housing.

Two cavities 26, 26', FIG. 4, extend through the housing from the wire-receiving face to the mating face and each cavity contains a terminal 8, 8'. The cavities and the terminals are mirror images of each other so that a description of one will suffice for both and only the cavity 26 and the terminal 8 will be described in detail.

The cavity 26 has opposed cavity end walls 28, 29 and opposed cavity side walls 30. The side walls are parallel to each other and are uninterrupted along their entire lengths. The end wall 29 is flat excepting for a ramp 32 adjacent to the wire-receiving face of the housing. The end wall 28 has a portion 34 which extends inwardly from the wire-receiving face of the housing, a portion 36 which is adjacent to the mating face of the housing, and an intermediate camming wall surface portion 38. The cavity is relatively wide at its entrance at the wire-receiving face 10 and narrow at the mating face 12. The nose 18 has a free end 40 which is spaced outwardly from the mating face, a first shoulder 42 which is adjacent to the mating face, and a second shoulder 44 which is proximate to the free end 40.

The terminals 8, 8' are stamped and formed as associated pairs with the spacing between the two terminals of each pair being equal to the spacing between the two cavities of a housing so that a pair of terminals can be separated from the carrier strip 46 to which they are attached and immediately inserted into the housing by an automatic insertion apparatus. The terminals are connected to the carrier strip 46 by short connecting neck sections 48 that are sheared at the time of insertion.

Each terminal has a wire-receiving portion 50 at one end thereof, an external contact portion 52 at the other end thereof, and a wire-connecting section or portion 54 intermediate its ends. The terminal comprises a continuous relatively narrow ribbon-like web 56 which extends from the one end at which the wire-receiving portion 50 is located to the external contact portion 52. The contact portion itself is an extension of this web and is formed as will be described below.

A side flange 58 extends from one of the side edges of the web and is against one of the side walls 30 of the associated cavity. The flange extends from the wire-receiving end of the terminal to an intermediate location and has an enlarged central portion 60. A contacting lancet 62 is integral with this central portion of the flange and extends from the flange to a free end 68. The portion of the lancet which is adjacent to the flange is straight as shown at 64 and the lancet is bent so that it is directed downwardly as shown at 66 and towards the web. The free end 68 is sharpened as by coining or swaging so that it will be capable of penetrating the insulation of an inserted wire and establishing electrical contact with the metallic core of the wire.

It is desirable to provide an insulation support or strain relief as shown at 70 on the intermediate portion of the side flange. This strain relief extends from the flange and is bent downwardly having a free end 72 which is spaced from the web. The distance between the free end 72 and the surface of the web 56 is advantageously such that when the wire is inserted, the insulation support will be flexed toward the front of the terminal and the free end will dig into the insulation of the wire to some extent. The insulation support will thus resist removal of the wire from the terminal if a tensile pull is applied to the wire.

The web advantageously has one or more retaining lances 74 struck therefrom which dig into the end wall 29 of the cavity when the terminal is moved to its fully inserted position. These lances thus retain the terminal in the cavity by an interference fit and prevent rearward movement of the terminal from the cavity after movement of the terminal to its fully inserted position.

A wire stop 78 is provided for an inserted wire in the form of an ear on the end of an arm 76 which projects forwardly from the side flange. This wire stop prevents movement of an inserted wire beyond the position shown in FIG. 6.

Figure 2:
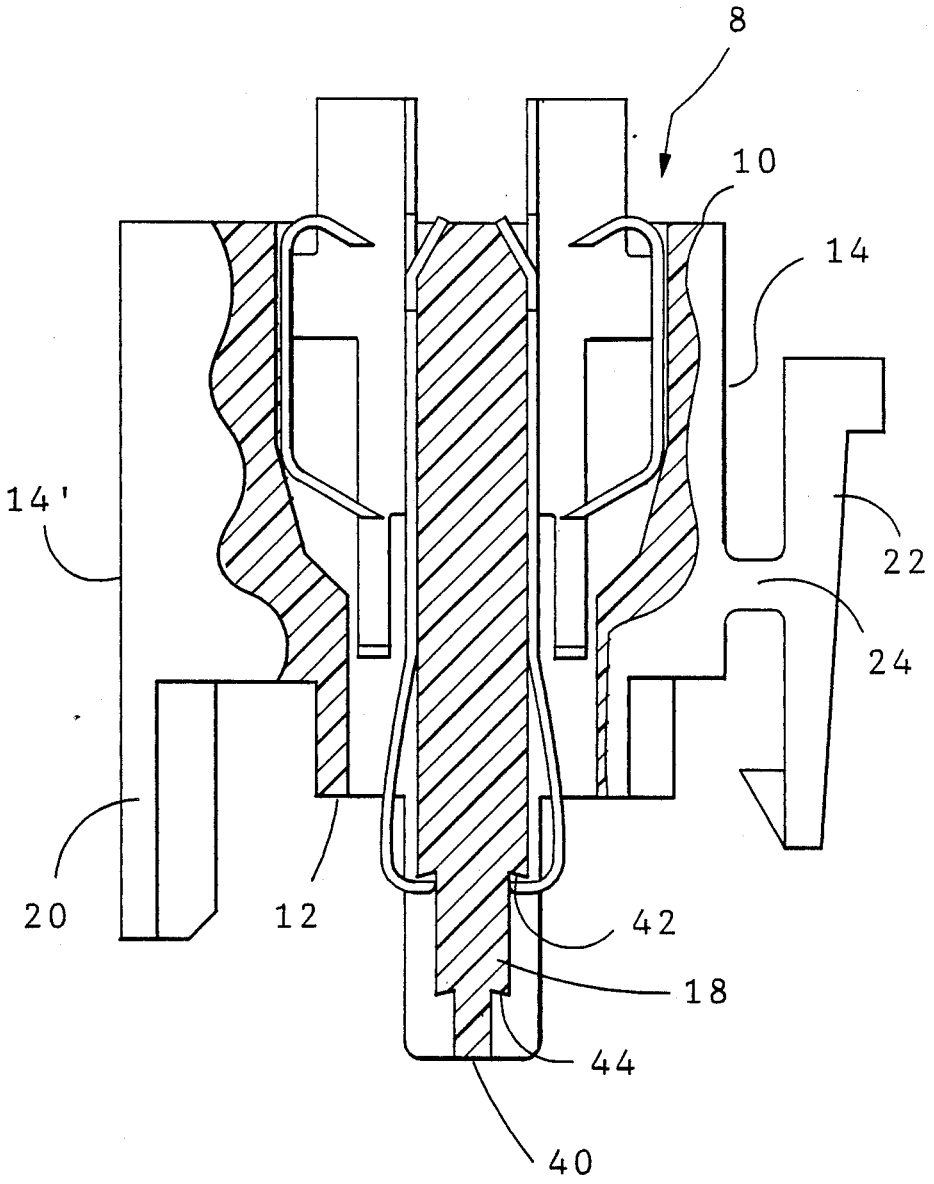
FIG. 2 is a view, partially in section, looking in the direction of the arrows 2—2 of FIG. 1.
Figure 1:
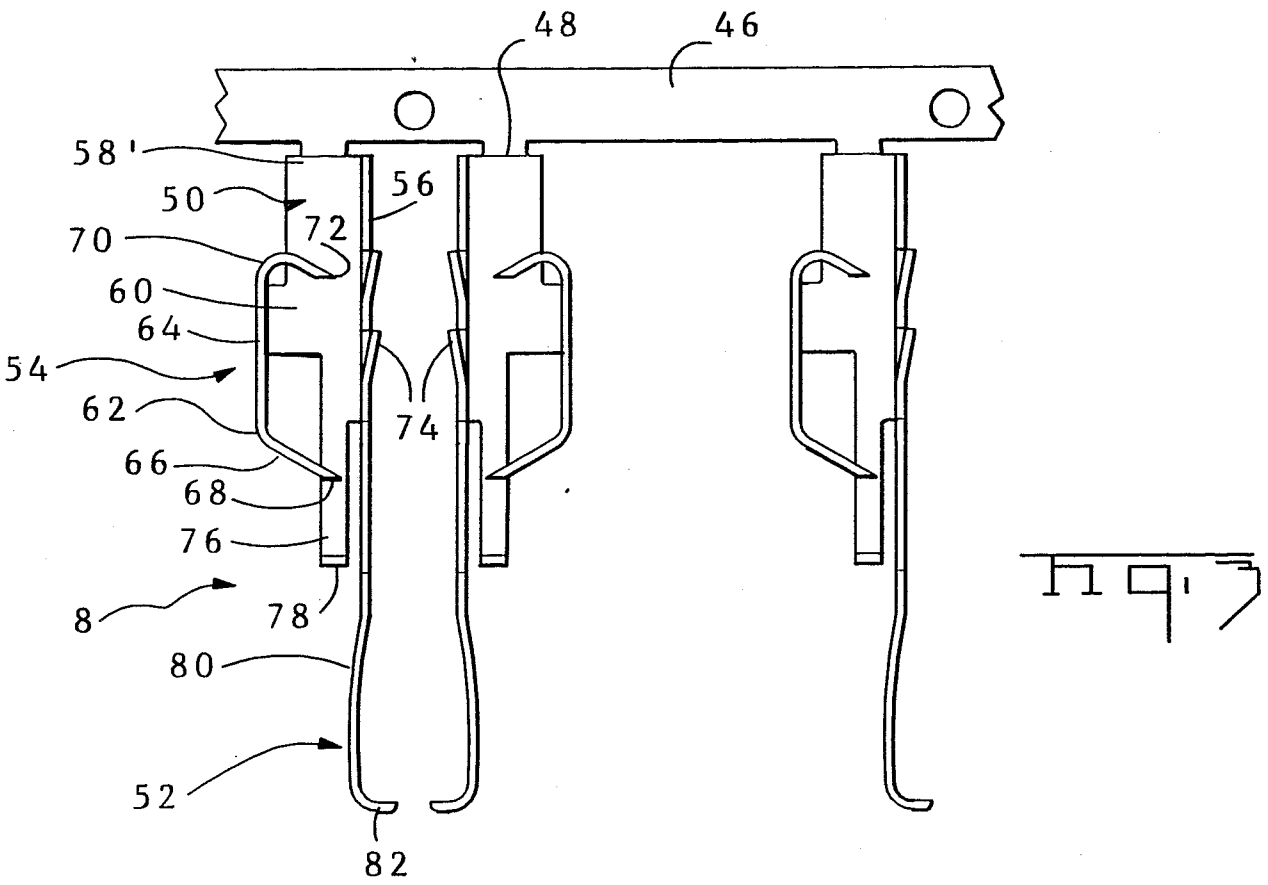
Figure 5:
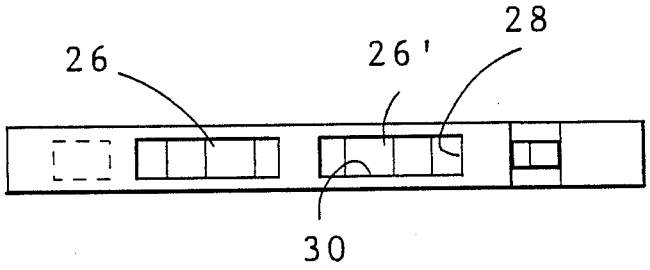
FIG. 5 is an end view looking in the direction of the arrows 5—5 of FIG. 4.

The external contact portion 52 is formed laterally away from the plane of the web as shown at 80 and has an inwardly turned end portion 82 for cooperation with the previously identified shoulders 42, 44 as shown in FIGS. 2 and 6.

When a technician wishes to install a plug connector 2 on the ends of a pair of wires, he merely inserts the wires into the terminals until the wire ends are against the wire stops 78. During insertion of the wire, the web 56, the end 72 of the strain relief arm 70, and the free end 68 of the lancet 66 function as a guide means for the wire. The technician thereafter pushes the terminals from their partially inserted positions of FIG. 2 to their fully inserted positions as shown in FIG. 6. This insertion operation can be carried out with any hard flat object such as the blade of a screwdriver. As the terminals move to their fully inserted positions, the camming wall portions of the cavities will engage the contacting lancets 62 and flex these lancets towards the webs of the terminals so that the lancet ends 68 will penetrate the insulation of the inserted wires and establish contact with the cores of the wires. After insertion, the camming wall portions will serve to maintain the free ends 68 in electrical contact to provide a stable electrical connection in each of the terminals.

The terminals can be produced of a suitable copper alloy, preferably a phosphur bronze and the housing can be produced from any suitable high-strength plastic material such as a polycarbonate composition. The housing shown can be produced at relatively low cost in view of the fact that it requires only a straight action type mold; that is, a mold which has core pins extending only in the direction of movement of the mold parts when the mold parts move between their open and closed positions. The mold does not require core pins extending transversely of the directions of movements of the mold parts. The latter type of mold is more complicated and more expensive than a straight action mold. It should be noted that the connecting neck 24 has an opening 84 therein for the accommodation of a core pin which is required to form the shoulder 86 on the end of the latch arm. The other surfaces and cavities or recesses in the housing can clearly be produced by core pins extending into and through the housing from the mating face to the wire-receiving face.

It will be apparent from the foregoing description that the principles of the invention permit the achievement of an easily applied two-position connector plug of a type used in the communications and data processing industries. The principles of the invention can, of course, be used in many other types of connectors, for example, connectors having a multiplicity of preloaded terminals therein of the general type shown in U.S. Pat. No. 3,760,335.

I claim:

1. An electrical connector comprising an insulating housing and at least one stamped and formed contact terminal in the housing, the housing having a conductor-receiving face, at least one terminal-receiving cavity extending into the housing from the conductor-receiving face, the terminal having a conductor-receiving portion at one end thereof and having a conductor contacting portion which is adjacent to the conductor-receiving portion, the terminal being partially inserted into the cavity and being movable from its partially inserted position to a fully inserted position, the connector-being characterized in that:

the conductor contacting portion has contacting means, comprising a single sharpened edge at the forward free end of the conductor contacting portion which is movable against, and into contacting engagement with, a conductor, the terminal having conductor guide means for guiding a conductor to the contacting means upon insertion of the conductor into the terminal from the one end thereof, and the cavity has camming surface portions defined by inwardly directed surfaces adjacent to the contacting means for moving the contacting means into engagement with a conductor during movement of the terminal from its partially inserted position to its fully inserted position whereby, upon insertion of a conductor into the terminal and subsequent movement of the terminal into the cavity to its fully inserted position, the contacting means will contact the conductor and the conductor will be electrically connected to the terminal.

2. An electrical connector as set forth in claim 1 characterized in that the terminal has a mating face which is oppositely directed with respect to the conductor receiving face, the cavity extending entirely through the housing to the mating face, the terminal having an external contact portion extending from the conductor contacting portion, the external contact portion being proximate to the mating face.

3. An electrical connector as set forth in claim 2 characterized in that the housing has a nose portion projecting from the mating face, the external contact portion extending onto the nose portion.

4. An electrical connector as set forth in claim 3 characterized in that the nose portion has a nose portion free end which is spaced from the mating face and the external contact portion of the terminal has an external contact portion free end which is spaced from the conductor contacting portion, the nose portion having first and second shoulders thereon for engagement with the external contact portion free end, the first shoulder being engageable with the external contact portion free end when the terminal is in its partially inserted position, the second shoulder being engageable with the external contact portion free end when the terminal is in its fully inserted position.

5. An electrical connector as set forth in claim 1 characterized in that the contact terminal has a web which extends from the one end to the conductor contacting portion, the contacting means comprising a contacting lancet which has a lancet free end, the lancet free end being adjacent to, and spaced from, the web, the contacting lancet being moved towards the web by the camming surface portions during movement of the terminal to its fully inserted position whereby the lancet free end moves against, and establishes electrical contact with, the conductor.

6. An electrical connector as set forth in claim 5 characterized in that the web has side edges which extend from the one end to the conductor contacting portion and a side flange extends from one of the side edges, the lancet being integral with, and extending from, the side flange.

7. An electrical connector as set forth in claim 6 characterized in that the terminal has a mating face which is oppositely directed with respect to the conductor-receiving face, the cavity extending entirely through the housing to the mating face, the terminal having an external contact portion extending from the conductor contacting portion, the housing having a nose portion projecting from the mating face, the external contact portion extending onto the nose portion.

8. An electrical connector as set forth in claim 7 characterized in that the nose portion has a nose portion free end which is spaced from the mating face and the external contact portion has an external contact portion free end, the nose portion having first and second shoulders thereon for engagement with the external contact portion free end, the first shoulder being engageable with the external contact portion free end when the terminal is in its partially inserted position, the second shoulder being engageable with the external contact portion free end when the terminal is in its fully inserted position.

9. An electrical connector as set forth in claim 8 characterized in that the terminal-receiving cavity has a pair of opposed sidewalls and a pair of opposed endwalls, the web being against one of the endwalls, the contacting lancet having portions which are against the other endwall, the contacting lancet having a deformable portion which extends from the side flange to the lancet free end, the camming surface portions of the cavity being on the other endwall and being engageable with the deformable portion of the lancet during movement of the terminal to its fully inserted position and being effective to move the lancet free end towards the web and towards a conductor which has been inserted into the terminal.

10. An electrical connector as set forth in claim 9 characterized in that the camming surface portions of the other endwall are inclined towards the one endwall.

11. An electrical connector as set forth in claim 10 characterized in that the side flange has an arm which extends towards the external contact portion and past the lancet free end, the arm having a laterally extending ear which serves as a conductor stop for a conductor upon insertion of the conductor into the terminal.

12. An electrical connector as set forth in claim 11 characterized in that a conductor strain relief is provided on the side flange between the contacting lancet and the one end, the strain relief comprising a flexible arm extending towards the web and inclined away from the one end whereby after insertion of a conductor into the terminal, the strain relief will bear against the conductor and retain the conductor in the terminal, and the web has at least one terminal retaining lance struck therefrom adjacent to the one end, the retaining lance extending towards the one end and divergently from the plane of the web whereby upon movement of the terminal to its fully inserted position, the retaining lance will bear against the one endwall and retain the terminal in the cavity.

13. A multi-contact electrical connector assembly which is intended for installation on the ends of a plurality of wires, the connector assembly comprising an insulating housing having a wire-receiving face and a mating face which is oppositely directed with respect to the wire-receiving face, a plurality of terminal-receiving cavities extending through the housing from the wire-receiving face to the mating-face, each of the cavities having a stamped and formed terminal therein, the connector assembly being characterized in that:

each of the terminals has a wire-receiving portion at one end thereof, an external contact portion at its other end, and a wire contacting portion intermediate its ends, each terminal having a wire supporting portion for supporting a wire upon insertion of the wire into the terminal form the one end towards the external contact portion, the wire contacting portion comprising wire contacting means which is spaced laterally from the wire supporting portion, the wire contacting means being movable towards the wire supporting portion, each terminal being partially inserted into its respective cavity and having at least part of its wire-receiving portion extending from the wire-receiving face of the housing, each terminal having its external contact portion proximate to the mating face, each terminal being movable from its partially inserted position to a fully inserted position, and each cavity having camming wall portions defined by surfaces converging inwardly towards the mating face which are engageable with the wire contacting means of its associated terminal upon movement of the terminal from its partially inserted position to its fully inserted position, the camming wall portions being effective to move the wire contacting means towards the wire supporting portion whereby, upon insertion of a wire into the wire-receiving portion of one of the terminals so that the wire extends past the wire contacting means and is supported on the wire supporting portion and thereafter moving the terminal to its fully inserted position, the wire contacting means will be moved into engagement with the wire and the terminal will thereby be electrically connected to the wire.

14. A multi-contact electrical connector assembly as set forth in claim 13 characterized in that each terminal comprises an elongated web which extends from the one end to a location proximate to the external contact portion, the web having one surface which serves as the wire supporting portion, the wire contacting means comprising a contacting lancet having a lancet free end, the camming wall portions being effective to deform the contacting lancet and move the lancet free end into engagement with the wire.

15. A multi-contact electrical connector assembly as set forth in claim 14 characterized in that the web of each terminal has side edges and a side flange extends from one of the side edges, the contacting lancet being integral with the side flange.

16. A multi-contact electrical connector assembly as set forth in claim 15 characterized in that each terminal receiving cavity has a pair of opposed sidewalls and a pair of opposed endwalls, the web being against one of the endwalls, the camming wall portions being on the other endwall, and the side flange is against one of the sidewalls.

17. A multi-contact electrical connector assembly as set forth in claim 16 characterized in that a conductor strain relief is provided on the side flange between the contacting lancet and the one end, the strain relief comprising a flexible arm which extends towards the web and is inclined away from the one end whereby after insertion of a conductor into the terminal, the strain relief will bear against the conductor into the terminal, the strain relief will bear against the conductor and retain the conductor in the terminal, and the web has at least one terminal retaining lance struck therefrom, the retaining lance extending towards the one end and divergently from the plane of the web whereby upon movement of the terminal to its fully inserted position, the retaining lance will bear against the one endwall and retain the terminal in the cavity.

18. A multi-contact electrical connector assembly as set forth in claim 16 characterized in that the housing has a nose portion extending from the mating face, the nose portion having a nose portion free end which is spaced from the mating face, the external contact portion of each terminal extending onto the nose portion, the external contact portion of each terminal extending onto the nose portion, the external contact portion having a contact end which is spaced from the nose portion free end, the external contact portion being movable along the nose portion upon movement of the terminal to its fully inserted position so that the contact end is located proximate to the nose portion free end.

19. A two-position electrical plug connector comprising an insulating housing having a mating face and a wire-receiving face which is oppositely directed with respect to the mating face, first and second terminal receiving cavities extending through the housing from the wire-receiving face to the mating face, first and second stamped and formed terminals in the first and second cavities respectively, the housing having oppositely directed sidewalls and oppositely directed endwalls extending between the wire-receiving face and the mating face, the cavities and the terminals being in mirror image relationship to each other with each terminal being proximate to one of the endwalls and remote from the other endwall, the housing having a nose portion which extends from the mating face, the nose portion having a nose portion free end which is spaced from the mating face, each terminal having an external contact portion which is proximate to the mating face, the plug connector being characterized in that:

each terminal has a wire-receiving portion at one end thereof, the one end being proximate to the wire-receiving face, and each terminal has a wire contacting portion which is between the wire-receiving portion and its external contact portion, each terminal being partially inserted into its respective cavity with at least part of its wire-receiving portion extending from the wire-receiving face of the housing, each terminal being movable from its partially inserted position to a fully inserted position, each terminal having a flat web which extends from the wire-receiving portion to the external contact portion, the wire contacting portion comprising a contacting lancet having a lancet free end which is spaced from the web, the lancet being deformable so that the lancet free end is moved towards the web, each cavitY having camming wall portions which engage the lancet during movement of the terminal from its partially inserted position to its fully inserted position thereby to move the lancet free end towards the web, the external contact portion being an extension of the web and having a contact free end which is located on the nose portion and spaced from the nose portion free end whereby, upon insertion of a wire into the terminal along the web until the wire extends past the lancet free end and upon moving the terminal from its partially inserted position to its fully inserted position, the contacting lancet is deformed and the lancet free end is moved against, and into electrical contact with, the wire, and the external contact portion is moved along the nose portion until the contact free end is proximate to the nose portion free

20. A two-position electrical plug connector as set forth in claim 19 characterized in that the web has side edges and a side flange extends from one of the side edges, the contacting lancet being integral with, and extending from, the side flange, the side flange having an arm extending therefrom towards the mating face, the arm having a wire stop extending laterally therefrom which is located between the lancet free end and the mating face, and a conductor strain relief is provided, the strain relief being between the one end and the contacting lancet, the strain relief comprising a flexible arm which extends from the side flange towards the web and is inclined away from the one end of the terminal, the arm being engageable with an inserted wire thereby to restrain the wire against movement from the terminal from the cavity after movement of the terminal to its fully inserted position.

* * * * *